United States Patent [19]

Sano

[11] Patent Number: 4,502,359

[45] Date of Patent: Mar. 5, 1985

[54] ELECTRONIC MUSICAL INSTRUMENT

[75] Inventor: Shigenori Sano, Tokyo, Japan

[73] Assignee: Casio Computer Co., Ltd., Tokyo, Japan

[21] Appl. No.: 547,454

[22] Filed: Oct. 31, 1983

Related U.S. Application Data

[63] Continuation of Ser. No. 361,470, Mar. 23, 1982, abandoned.

[30] Foreign Application Priority Data

Mar. 31, 1981 [JP] Japan ..... 56-47644
Jun. 11, 1981 [JP] Japan ..... 56-90641

[51] Int. Cl.[3] ..... G10H 1/00
[52] U.S. Cl. ..... 84/1.19; 84/1.01; 84/1.24
[58] Field of Search ..... 84/1.19, 1.01, DIG. 2, 84/1.24, 1.26

[56] References Cited

U.S. PATENT DOCUMENTS

| | | | |
|---|---|---|---|
| 4,157,049 | 6/1979 | Watanabe | 84/345 |
| 4,173,167 | 11/1979 | Stanley | 84/345 |
| 4,256,004 | 3/1981 | Takeuchi | 84/1.21 |
| 4,267,762 | 5/1981 | Aoki et al. | 84/1.24 |
| 4,283,984 | 8/1981 | Faulkner | 84/1.03 |
| 4,286,491 | 9/1981 | Deutsch | 84/1.24 |
| 4,287,802 | 9/1981 | Imamura et al. | 84/1.01 |
| 4,297,933 | 11/1981 | Nishimoto | 84/1.19 |
| 4,306,482 | 12/1981 | Kashio | 84/1.03 |
| 4,338,849 | 7/1982 | Turner | 84/1.19 |

*Primary Examiner*—Forester W. Isen
*Attorney, Agent, or Firm*—Frishauf, Holtz, Goodman & Woodward

[57] ABSTRACT

In an LSI chip including a control section and a tone generating section, a plurality of tones are simultaneously produced in a time division basis processing for a plurality of channels. The control section is coupled to a keyboard and a performance memory via bus lines, and the control section controls the tone generating section such that a tone having specified tone color and pitch is selectively provided for a particular channel.

17 Claims, 12 Drawing Figures

| | |
|---|---|
| FIG. 2A-1 | FIG. 2A-2 |
| FIG. 2B-1 | FIG. 2B-2 |
| FIG. 2C-1 | FIG. 2C-2 |

ELECTRONIC MUSICAL INSTRUMENT

This application is a continuation of application Ser. No. 361,470, filed Mar. 23, 1982, now abandoned.

BACKGROUND OF THE INVENTION

This invention relates to electronic musical instruments in which a single tone generating circuit is used for a plurality of channels on a time division basis to simultaneously produce a plurality of tones from the respective channels.

In order to permit chord performance using an electronic musical instrument, the electronic musical instrument has to be able to simultaneously produce a plurality of tones. To this end, it is thought to provide the electronic musical instrument with a plurality of tone generating circuits and permit a plurality of predetermined tones to be simultaneously produced from respective tone generating circuits specified by performance keys or to permit a single tone generating circuit to be used for a plurality of channels on a time division basis to simultaneously produce a plurality of tones from the respective channels. Either of these two methods can be used without any difficulty in a case where a plurality of simultaneously produced tones are of the same tone color. However, when at least one of the plurality of tones is different in tone color from the remaining tones, various problems are presented. In the case of the former method, it is possible to simply produce tones having different tone colors from respective tone generating circuits. On the demerit side, however, a great deal of hardware is necessary, leading to high cost. Also, with this method it is difficult to provide a compact and inexpensive electronic musical instrument. The latter method requires less hardware compared to the former method and permits construction of a compact instrument. However, when channels are switched in the time division basis operation, difficulties are involved in the control of switching a tone color over to another tone color, and an electronic musical instrument based on the latter method and having satisfactory performance has, as far as is known, not yet been realized.

SUMMARY OF THE INVENTION

An object of the invention is to provide an electronic musical instrument, in which a single tone generating circuit is used for a plurality of channels on a time division basis to simultaneously produce a plurality of tones from respective channels, and which permits a tone having predetermined characteristics to be selectively obtained for each channel.

According to the present invention, this object is attained by an electronic musical instrument, in which a plurality of tones are simultaneously produced for respective channels through a time division basis processing, and which comprises channel control means for controlling channels such that at least two tones of different kinds can be selectively produced for at least one of a plurality of channels provided by time division, and tone generating means for generating tones of characteristics assigned to the respective channels in a time division basis processing based on control of the channel control means.

BRIEF DESCRIPTION OF THE DRAWINGS

FIGS. 2A-1 through 2C-2 constitute a detailed circuit diagram showing a tone generating section in the LSI chip in FIG. 1;

DETAILED DESCRIPTION OF THE PREFERRED EMBODIMENTS

The present invention will now be described in conjunction with preferred embodiments with reference to the accompanying drawings.

Figure 1:
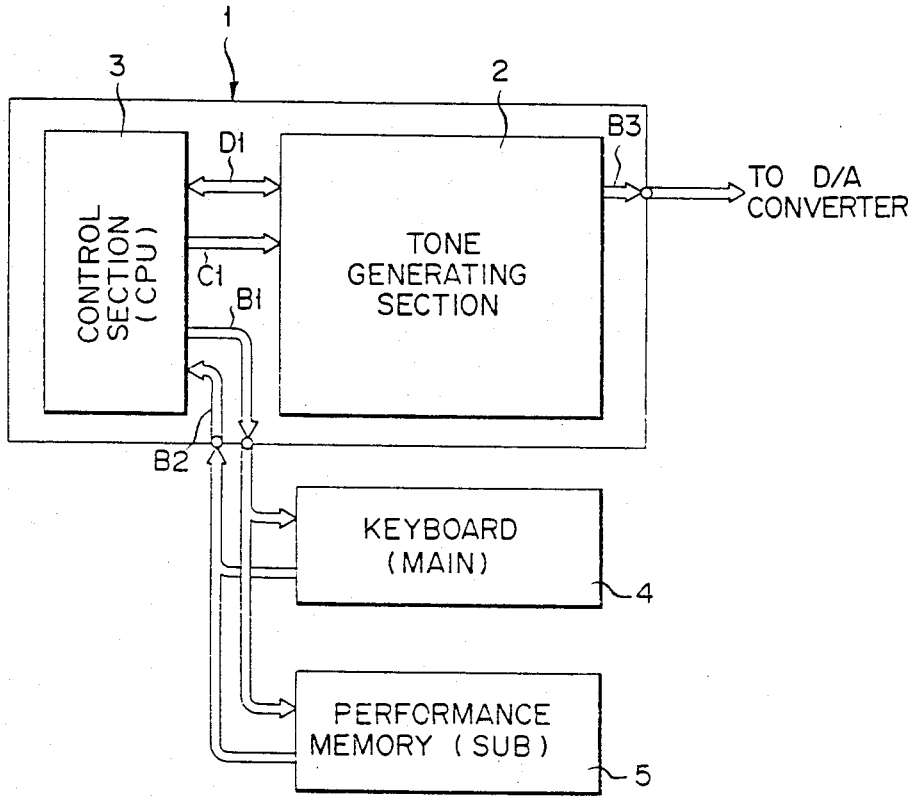
FIG. 1 is a block diagram showing an LSI chip and external units used in one embodiment of the invention.
Figures 1, 2A:
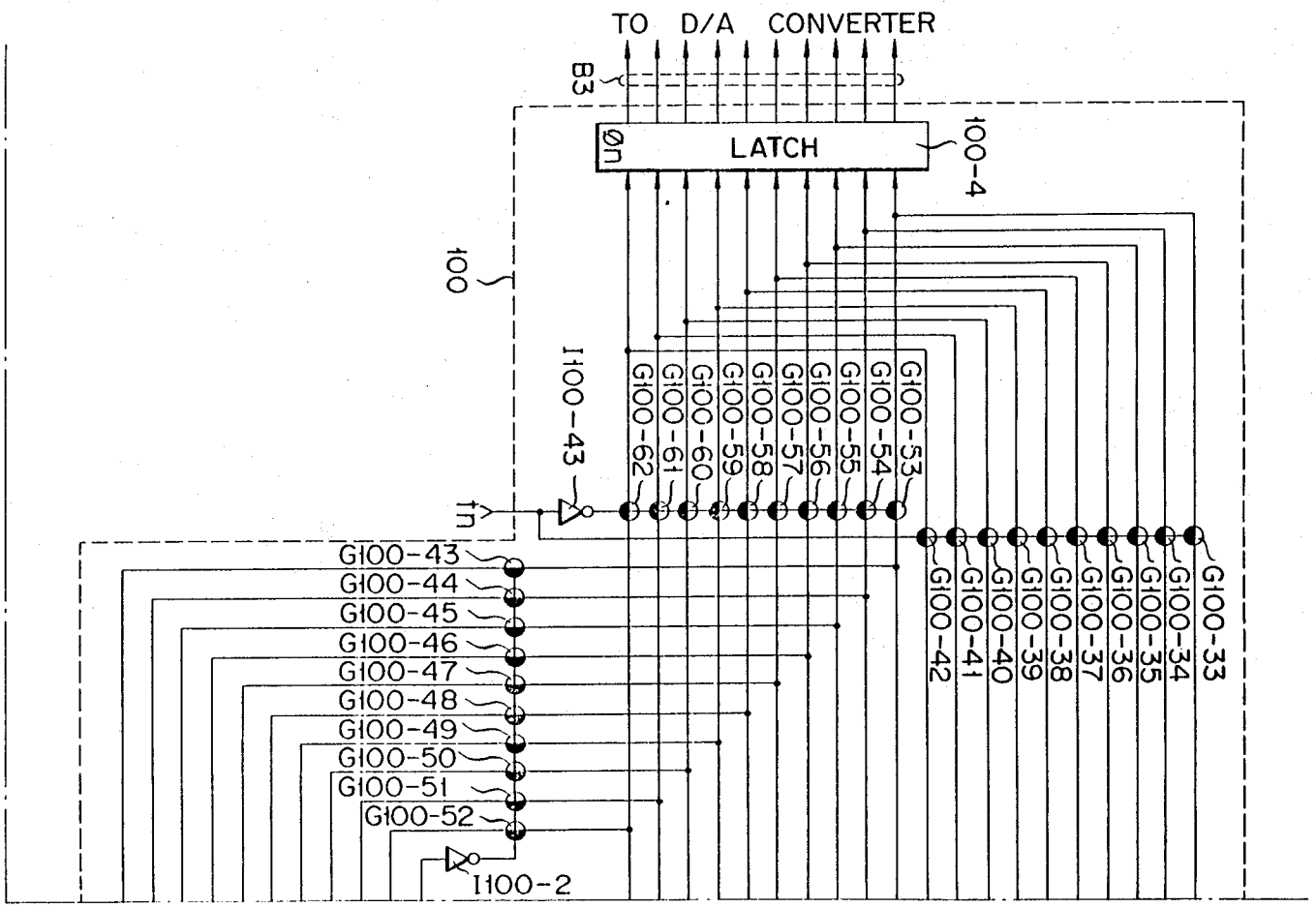
Figures 2, 2A:
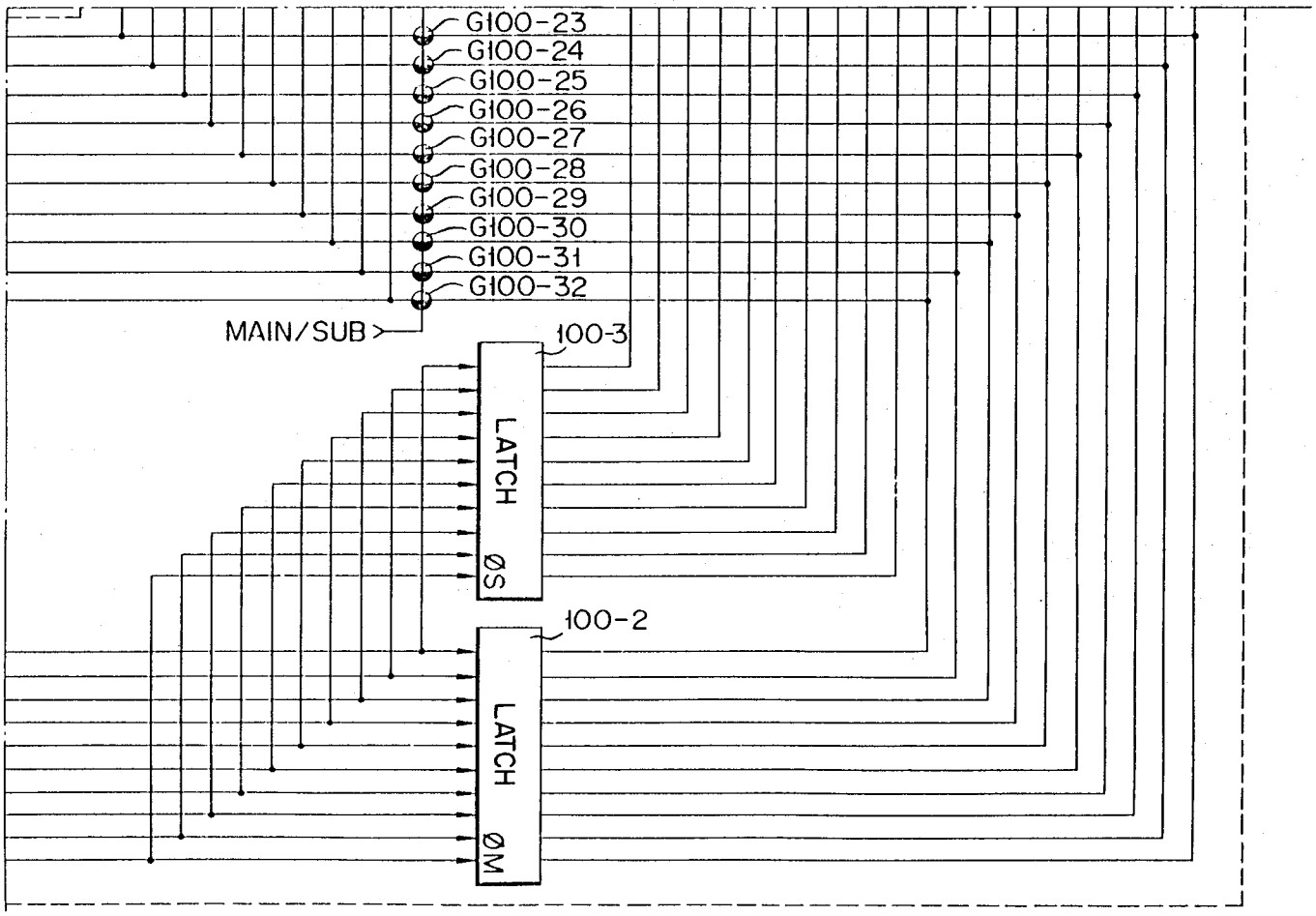
Figures 1, 2B:
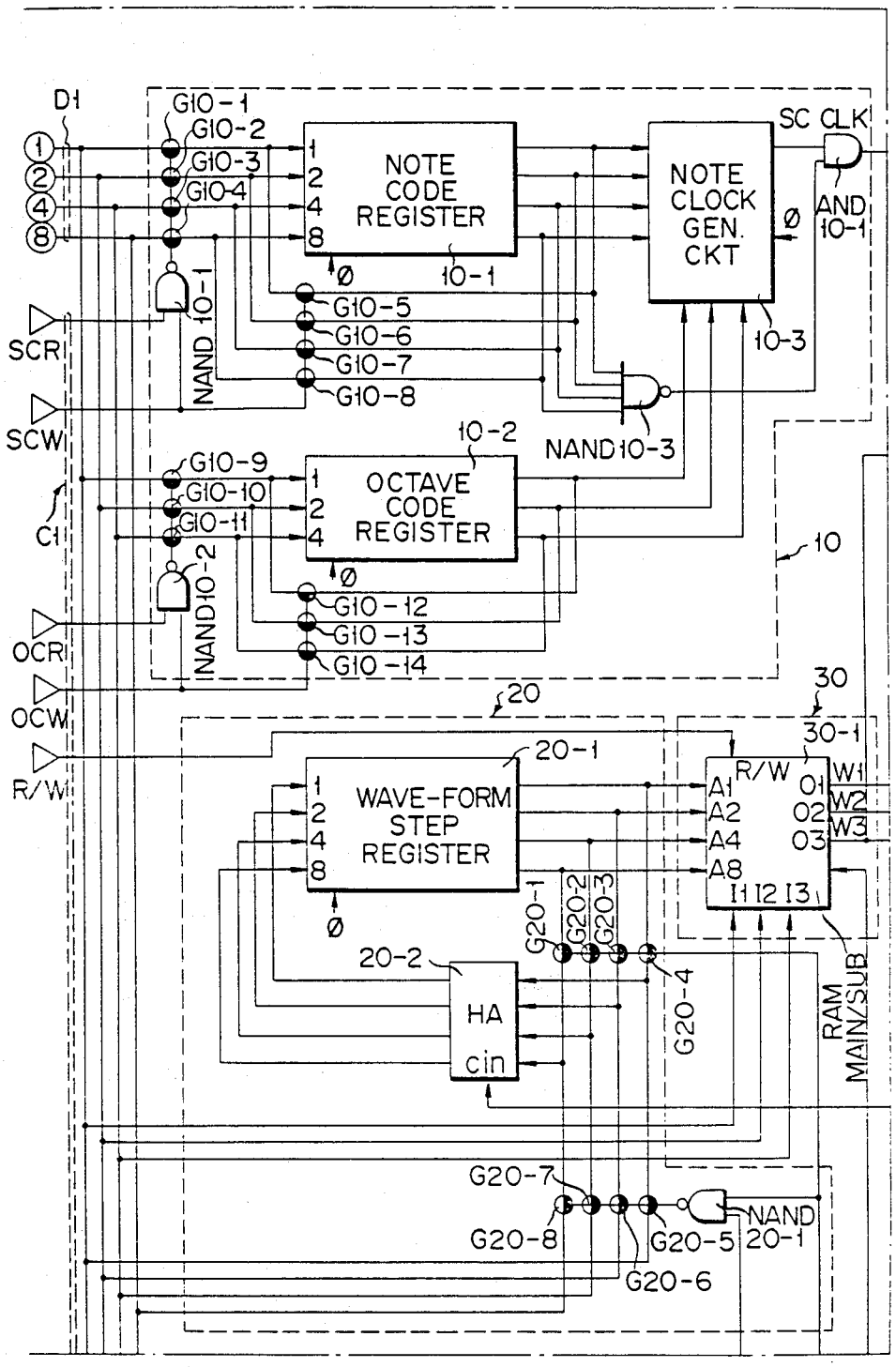
Figures 2, 2B:
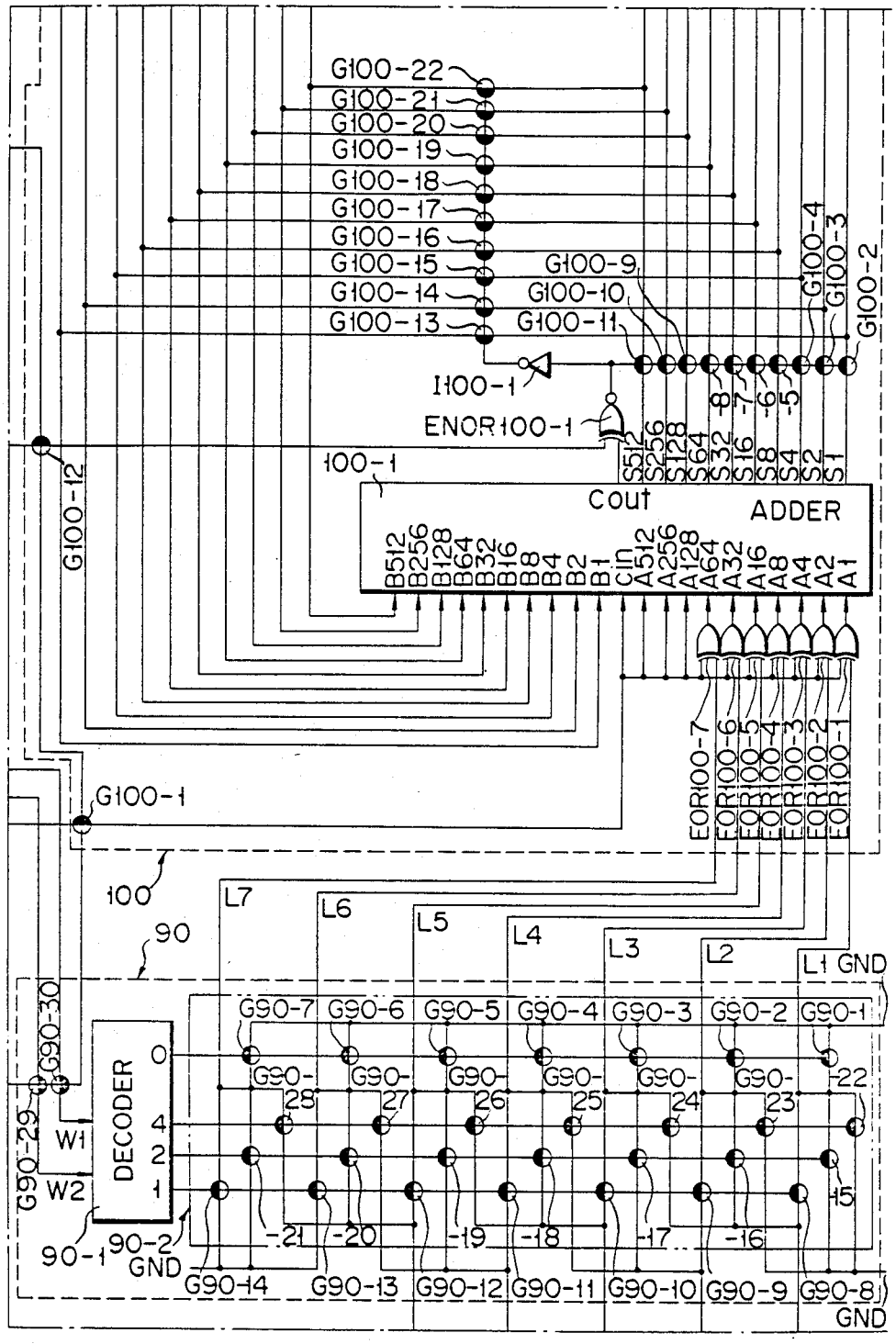
Figures 1, 2C:
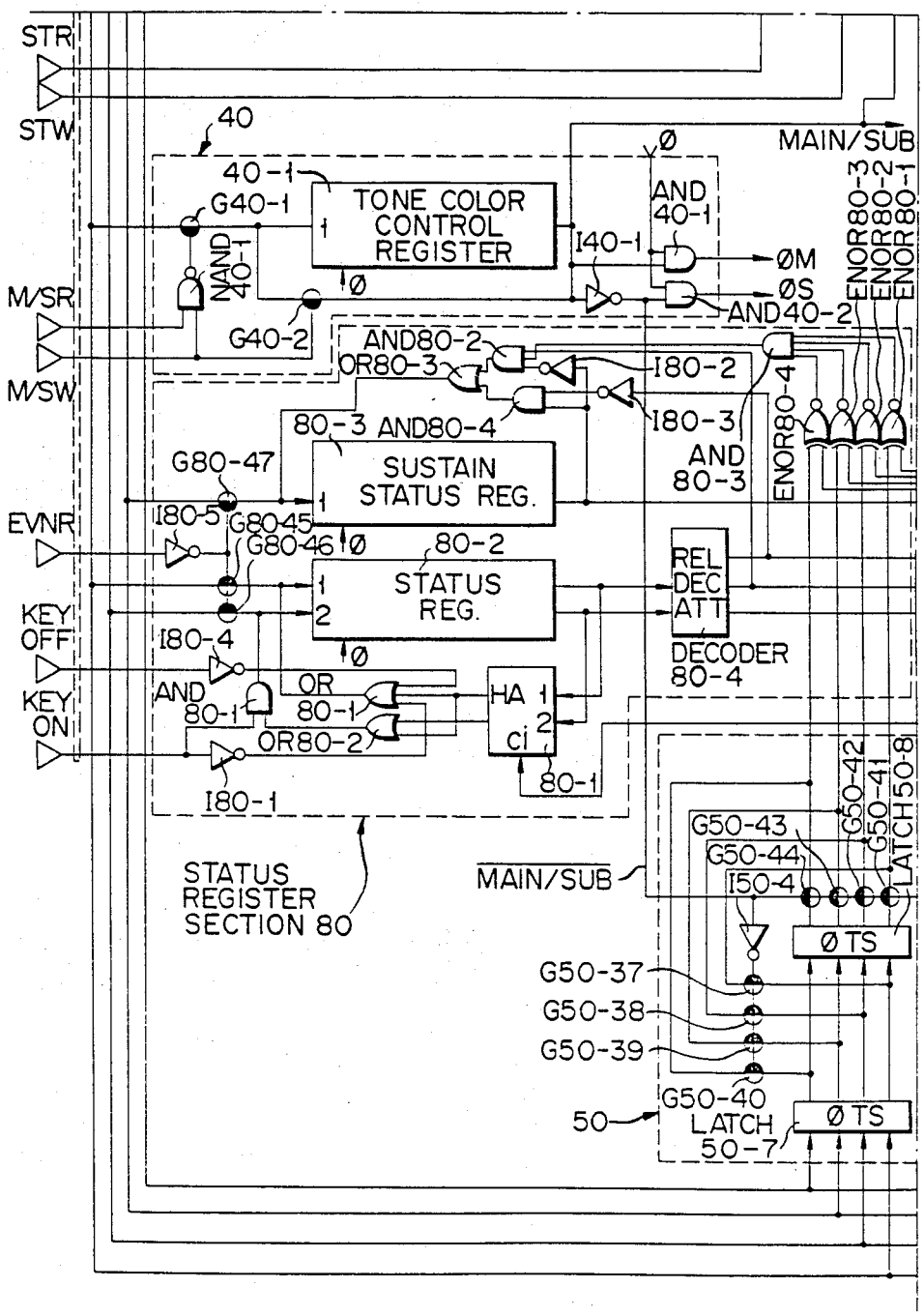
Figures 2, 2C:
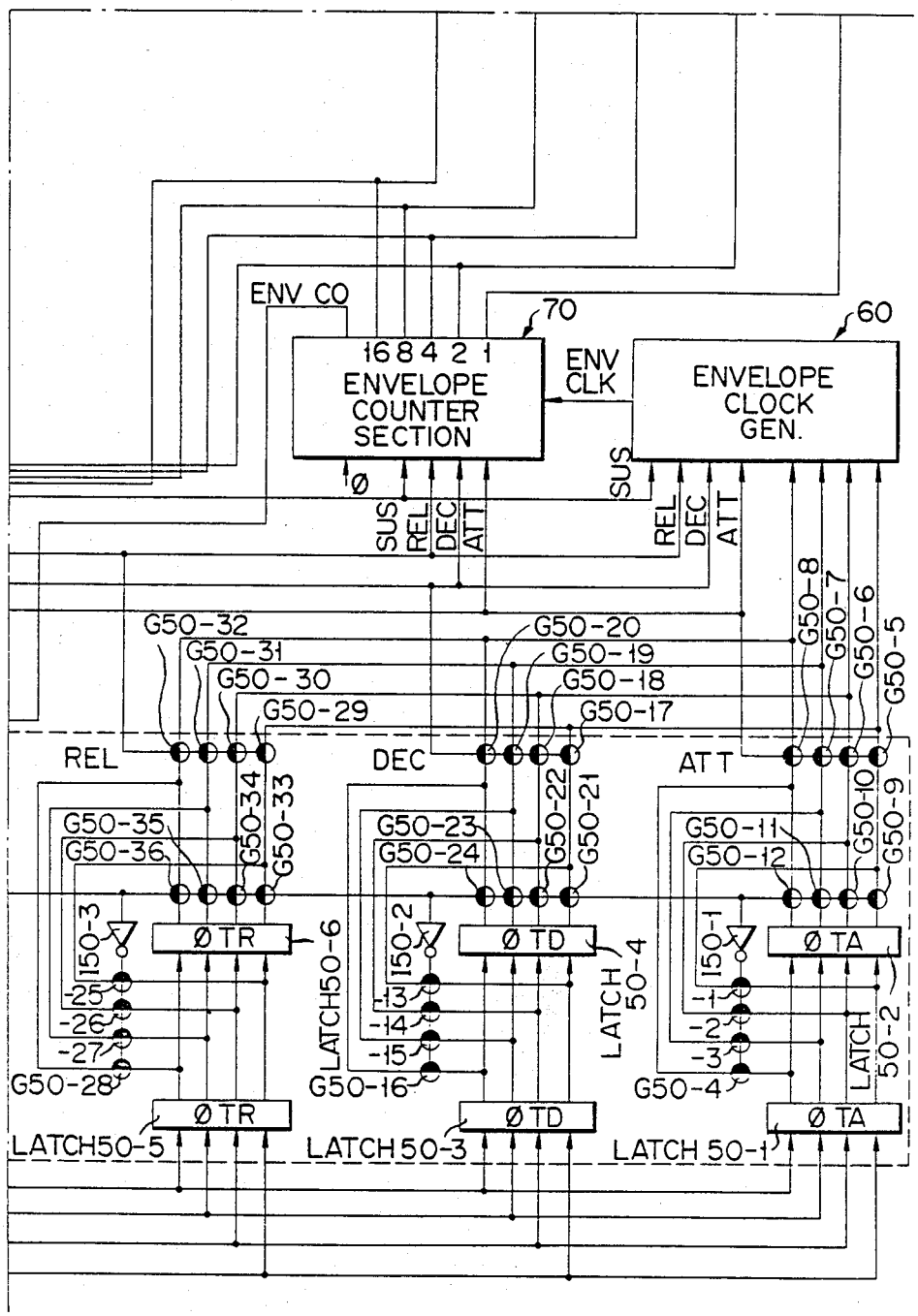

FIG. 1 shows a first embodiment of the invention. The embodiment comprises an LSI chip which includes a tone generating section 2 and a control section 3, e.g. a central processing unit (CPU). The chip 1 is coupled to a keyboard 4 and a performance memory 5, e.g. a RAM, through bus lines B1 and B2. The control section 3 is coupled to the tone generating section 2 through a data bus D1 and a control bus C1. The control section 3 supplies various signals through the bus line B1, such as signals for scanning key switches included in the keyboard 4 and external switches, address signals to be supplied to the performance memory 5 and read/write control signals. The control section 3 receives through the bus line B2 signals from the key switches and the external switches and data read from the performance memory 5.

The keyboard 4 is operated by a player to achieve a manual main performance. The data stored in the performance memory 5 is used to achieve an automatic performance. The largest of the data stored in the memory 5 is 4-channel data, each channel representing one of the chord-defining tones. The memory 5 is comprised of a RAM or a ROM.

The musical instrument of FIG. 1 further comprises a plurality of switches which are selectively operated thereby to designate a color of musical tones generated according to the signals generated by depressing the key switches and the data read from the performance memory 5. Therefore, the musical instrument may generate tones having the color the player selects. The musical instrument further comprises switches which are operated to allot the key switches of the keyboard 4 and the address of the performance memory 5 to five time-sharing data processing channels. Through time-sharing data processing, which will later be described, the musical instrument can simultaneously generate four musical tones in accordance with the output signals from the keyboard 4 and the data from the performance memory 5.

The control section 3 supplies through the bus lines C1 and D1 to the tone generating section 2, data instructing the section 2 to generate musical tone of a selected color. The data bus D1, which couples the control section 3 to the tone generating section 2, is a 4-bit bidirectional data bus, and the control bus C1, which also couples the section 3 to the section 2, is a unidirectional line and supplies data from the section 3 to the section 2, not vice versa. The output signals from the tone generating section 2 are supplied via a bus line B3 to an external D/A converter.

Figures 3, 4:
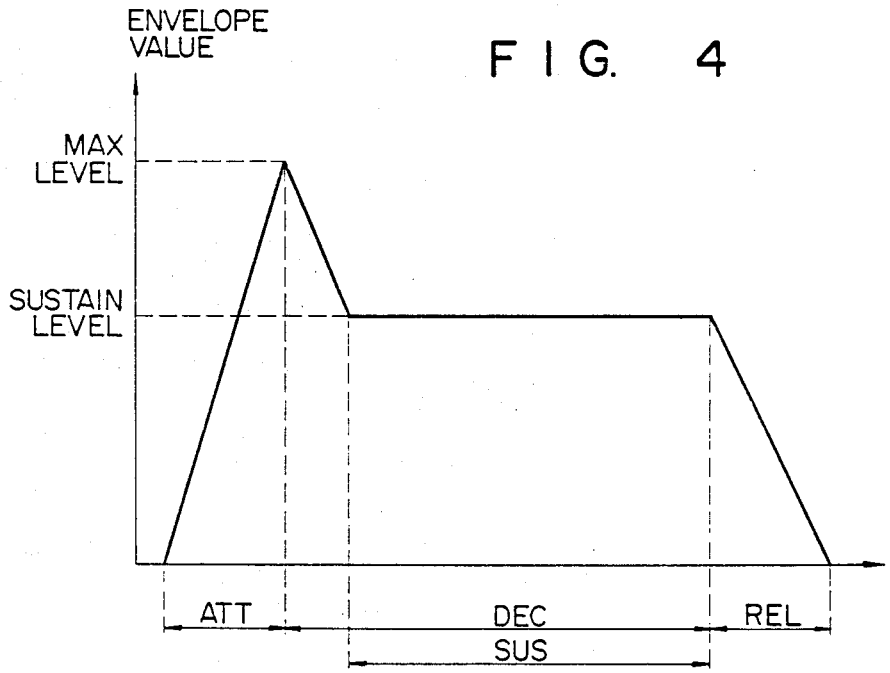
FIG. 3 is a view showing the mutual positional relation of FIGS. 2A-1 through 2C-2.
FIG. 4 is a diagram showing an envelope waveform of a generated tone.

Referring to FIGS. 2A-1 to 2C-2, the tone generating section 2 will be described in detail. FIGS. 2A-1 to 2C-2 show different parts of the section 2, and FIG. 3 illustrates the positional relation of these parts.

The tone generating section 2 roughly consists of 10 blocks as shown in FIGS. 2A-1 through 2C-2. The functions of the individual blocks are briefly as follows.

A block 10 constitutes a tone stage clock generating section which generates a scale clock SC CLK as a reference, under the control of which a tone of an assigned pitch is generated. This scale clock generating section 10 is operated on a time division basis for 4 channels.

A block 20 is a waveform step counter section, which up-counts according to the scale clock SC CLK from the scale clock generating section 10 and provides its content to a waveform RAM section 30. The waveform step counter section 20 is also operated on the time division basis for 4 channels.

A block 30 is the waveform RAM section as mentioned above, which divides a tone waveform into 16 steps and stores waveform amplitude difference values for the individual steps. As will be described later, in detail, the waveform RAM section stores two different waveforms MAIN and SUB and selectively provides the difference value for either waveform for each channel.

A block 40 is a channel control section, which controls the tone generated for each of the four channels by setting either one of two different tone characteristics. The channel control section 40 provides a control signal MAIN/SUB and clocks ØM and ØS for each channel.

A block 50 is an ADSR register section, in which two different kinds of envelope data (MAIN and SUB) are stored. Either one of these envelope data is selected for each channel according to a control signal MAIN/SUB from the channel control section 40.

A block 60 is an envelope clock generating section, which supplies an envelope clock to an envelope counter section 70 at a predetermined speed on the basis of envelope data given from the ADSR register section 50. The envelope clock generating section 60 is also operated on the time division basis for four channels.

A block 70 is the envelope counter section mentioned above, which effects counting operation under the control of the envelope clock ENV CLK supplied from the envelope clock generating section 60. The envelope counter section 70 transmits 5-bit envelope data to a multiplying section 50 and also supplies its content to a status register section 80, in which the envelope status is stored. Further, it transmits an envelope carry signal ENVCO for renewing the status to the envelope status section 80. Of course, the envelope status section 70 is operated on the time division basis for four channels.

A block 80 is the status register section mentioned above, in which envelope status data is stored, and which effects the control of selecting data provided from the ADSR register section 50 according to the stored data and also such control as the start and stop of production of musical sound. This status register section 80 is also operated on the time division basis for four channels.

A block 90 is the multiplying section mentioned above, which multiplies waveform difference value data supplied from the waveform RAM section 30 and envelope data supplied from the envelope counter section 70, and transmits the result data to an accumulating section 100.

In the accumulating section 100, envelope controlled waveform difference value data is accumulated to obtain amplitude value data at each sampling point of the waveform, and the output of which is supplied to an outside D/A converter via a bus line B3. In order to permit external control of varying the sound volume ratio of two different kinds of tones (MAIN and SUB) and also permit control of switching an external filter (which is an analog circuit) for one of the two different kinds of tones, the accumulating section 100 is adapted to alternately provide waveform amplitude data of the two kinds by dividing the individual time division basis processing periods (for the four channels) into two sections.

Thus, with the circuit construction of this embodiment, performance with the keyboard 4, or by the performance memory 5, is materialized through the time division basis processing for the four channels to permit tones having the "MAIN" characteristics to be generated in some of the four channels and tones having the "SUB" characteristics to be generated in other channels. For example, by representing the MAIN side by data "1" and the SUB side by data "0" it is possible to obtain control as to the assignment of the four channels to tones of the MAIN characteristics and tones of the SUB characteristics.

TABLE 1

| Channel | | | | Number of MAIN characteristics | Number of SUB characteristics |
|---|---|---|---|---|---|
| 1 | 2 | 3 | 4 | tones | tones |
| 0 | 0 | 0 | 0 | 0 | 4 |
| 1 | 0 | 0 | 0 | 1 | 3 |
| 0 | 1 | 0 | 0 | | |
| 0 | 0 | 1 | 0 | | |
| 0 | 0 | 0 | 1 | | |
| 1 | 1 | 0 | 0 | 2 | 2 |
| 1 | 0 | 1 | 0 | | |
| 1 | 0 | 0 | 1 | | |
| 0 | 1 | 1 | 0 | | |
| 0 | 1 | 0 | 1 | | |
| 0 | 0 | 1 | 1 | | |
| 1 | 1 | 1 | 0 | 3 | 1 |
| 1 | 0 | 1 | 1 | | |
| 1 | 1 | 0 | 1 | | |
| 0 | 1 | 1 | 1 | | |
| 1 | 1 | 1 | 1 | 4 | 0 |

The MAIN and SUB may be, respectively, melody tone and accompaniment tone or, respectively, automatic performance tone and manual performance tone. In general, by arranging the control section 3 to control the kind of performance, the two different kinds of tones can be provided in any desired manner within the four channels, and thus very high versatility can be obtained.

Now, the detailed construction of the individual sections will be described.

[1] Scale or tone stage clock generating section 10

The scale or mate clock generating section 10 includes a scale code register 10-1 and an octave code register 10-2. The registers 10-1 and 10-2 consist of shift registers which shift data under the control of a clock Ø (see (a) in FIG. 5). The scale code register 10-1 effects 4-bit parallel shifting in four stages, and the octave code register 10-2 effects 3-bit parallel shifting in four stages.

The relation between the scale code stored in the scale, code register 10-1 and the scale and the relation between the octave code stored in the octave code register 10-2 and the octave, are as shown in Tables 2 and 3.

TABLE 2

| Scale code | | | | |
|---|---|---|---|---|
| 8 | 4 | 2 | 1 | Scale |
| 0 | 0 | 0 | 0 | C |
| 0 | 0 | 0 | 1 | C# |
| 0 | 0 | 1 | 0 | D |
| 0 | 0 | 1 | 1 | D# |
| 0 | 1 | 0 | 0 | E |
| 0 | 1 | 0 | 1 | F |
| 0 | 1 | 1 | 0 | F# |
| 0 | 1 | 1 | 1 | G |
| 1 | 0 | 0 | 0 | G# |
| 1 | 0 | 0 | 1 | A |
| 1 | 0 | 1 | 0 | A# |
| 1 | 0 | 1 | 1 | B |
| 1 | 1 | 1 | 1 | Special code |

TABLE 3

| Octave code | | | |
|---|---|---|---|
| 4 | 2 | 1 | Octave |
| 0 | 0 | 0 | First octave |
| 0 | 0 | 1 | Second octave |
| 0 | 1 | 0 | Third octave |
| 0 | 1 | 1 | Fourth octave |
| 1 | 0 | 0 | Fifth octave |
| 1 | 0 | 1 | Sixth octave |
| 1 | 1 | 0 | Seventh octave |
| 1 | 1 | 1 | Eighth octave |

In Table 2, the special code "1111" has a function of stopping the output of the scale clock SC CLK, that is, the special code "1111" is coupled in a case where no tone is generated from the relevant channel.

To the scale code register 10-1 4-bit scale codes are supplied from the control section 3 through the data bus D1. The 4-bit code is coupled through transfer gates G10-1 to G10-4 to input terminals of the scale code register 10-1. The transfer gates G10-1 to G10-4 (and all the other transfer gates) are enabled when a gate voltage is at a high (logic "1") level. Thus, when a control signal SCW supplied from the control section 3 through the control bus C1 (which is usually at the high levels as well as all the other control signals) goes to a low level, the output of the NAND gate NAND10-1 goes to a high level, whereupon the transfer gates G10-1 to G10-1 mentioned above are enabled.

Meanwhile, transfer gates G10-5 to G10-8 are disabled at this time, and new content is written in the scale code register 10-1 as the scale code which is generally recirculated from the output terminal of the scale code register 10-1 to the input terminal thereof. Each channel is synchronized to each of timing signals t1 to t4 shown in (g) to (j) in FIG. 5, and the content of the scale code register 10-1 is renewed at the timing of a selected channel corresponding to one of the timing signals t1 to t4 generated from the control section 3.

A control signal SCR is supplied to the NAND gate NAND10-1 from the control section 3 through the control bus C1. When the control signal SCR goes to a low level, the transfer gates G10-1 to G10-4 are enabled, and the scale code output from the scale code register 10-1 is supplied to the control section 3 through the data bus D1. Thus, the content of the scale code register 10-1 is also judged in the control section 3.

Like the scale code register 10-1, to the octave code register 10-2 octave codes are supplied from the control section 3 and written therein, and also the content of the octave code register 10-2 can be read out and supplied to the control section 3 through the data bus D1.

Transfer gates G10-9 to G10-11 are connected to the lines with weights "1", "2" and "4" of the data bus D1. At the time of the appearance of a control signal OCW or at the time of the appearance of a control signal OCR, the output of a NAND gate NAND10-2 goes to a high level to permit the control of the input and output with respect to the octave code register 10-2. Transfer gates G10-12 to G10-14 are disabled when a control signal OCW (which is usually at a high level) goes to a low level to cut the recirculation loop so that a new octave code is coupled through the transfer gates G10-9 to G10-10.

The contents of the scale code register 10-1 and octave code register 10-2 are supplied to the scale or note clock generator 10-3. The scale clock generator 10-3 may be of a well-known construction. For example, U.S. patent application Ser. No. 20,749 filed on Mar. 15, 1979 by the applicant and entitled "Tone Waveform Setting System in Electronic Musical Instrument" discloses a detailed circuit construction similar to the scale clock generating circuit 10-3. More particularly, the scale clock generating circuit 10-3 includes a 4-channel shift register, a matrix circuit (ROM), in which the addition number is selected according to a scale code and octave code, an adder and so forth. The scale clock generating circuit 10-3 generates a scale clock SC CLK corresponding to the scale code and octave code for each channel. The scale clock SC CLK is supplied through an AND gate AND10-1 to the waveform step counter section 20, multiplying section 90 and accumulating section 100. To one input terminal of the AND gate AND10-1 is supplied the output of a NAND gate NAND10-3, the logic value of which becomes "0" at the time of appearance of the special code "1111" mentioned above. Thus, if the special code is not supplied to the scale code register 10-1, the AND gate AND10-1 provides the scale clock SC CLK supplied from the scale clock generating circuit 10-3.

The scale clock SC CLK is a clock having a frequency that is determined for each tone pitch, and a time length corresponding to 16 clock pulses of this clock corresponds to the period of the relevant tone pitch. Thus, in the case of the tempered scale, the frequency of the clock SC CLK is different by $\sqrt[12]{2}$ times between semi-tones.

[2] Waveform step counter section 20

The waveform step counter section 20 includes a waveform step register 20-1 and a half adder 20-2 for causing progress of the content of the section 20 (step data). The waveform step register 20-1 consists of a shift register which shifts data under the control of the clock Ø (see (a) in FIG. 5). It effects 4-bit parallel shifting in four stages. The waveform step register 20-1 specifies an address of the waveform RAM section 30 in 16 steps of "0" to "15".

Its content is advanced as the scale clock SC CLK supplied from the scale clock generating section 10 is supplied to a carry input terminal Cin of the half adder 20-2.

A control signal STW and a control signal STR are supplied from the control section 3 to the waveform step counter section 20 through the control bus C1. The control signal STW is usually at a high level. While a recirculation loop is constituted with the step data provided from the output terminal of the waveform step register 20-1 supplied to the half adder 20-2 through the transfer gates G20-1 to G20-4, when the control signal STW is set as the low level signal, the transfer gates G20-1 to G20-4 are disabled while transfer gates G20-5 to G20-8 connected to a NAND gate NAND20-1 are enabled. Thus, 4-bit data supplied from the control section 3 through the data bus D1 can be written as the step data of waveform. In this case, the control section 3 can effect control as to the selection of one of the channels according to the timing signals t1 to t4 shown in (g) to (j) in FIG. 5.

The control signal STR is usually at a high level. When this signal is changed to a low level, the transfer gates G20-5 through G20-8 are enabled, whereby the step data is transmitted from the waveform step register 20-1 through the data bus D1 to the control section 3 so that the control section 3 can judge the step of the specified channel.

[3] Waveform RAM section 30

The waveform RAM section 30 includes a waveform RAM section 30-1. To the waveform RAM 30-1 are supplied difference values of two different waveforms (MAIN and SUB) in 16 steps (one step being expressed in 3 bits). Also, data corresponding to the step data "0" to "15" supplied from the output terminal of the waveform step register 20-1 and the signal MAIN/SUB from the channel control section 40 is read out from the waveform RAM 30-1.

More particularly, the waveform RAM 30-1 has a capacity of 96 bits, more particularly 2 bits (for the different kinds of tones) by 16 bits (for steps) by 3 bits, and it has address terminals A1 to A4, a terminal MAIN/SUB, data input terminals I1 to I3 and a read/-write terminal R/W.

To write a predetermined waveform from the control section 3 to the waveform RAM 30-1, relevant data is coupled to the data input terminal I1 to I3 through the lines with the weights "1", "2" and "4" of the data bus D1. When the control signal R/W is set to the low level, the aforementioned waveform is written in a waveform area, the address of which is specified by the waveform step register 20-1 and which is selected by the signal MAIN/SUB supplied from the channel control section 40 to be described later.

Thus, for writing predetermined data in the waveform RAM 30-1, data may be rewritten according to the control signals STW and M/SW from the control section 3 and the data from the data bus D1 such as to specify an area, in which the content of the waveform step register 20-1 or the content of a tone color control register 40-1 in the channel control section 40 is to be written, and addresses of the waveform RAM 30-1 may be progressively specified by that data.

The data that is written in this way for each step consists of 3 bits w1 to w3. Of these bits the first and second bits w1 and w2 represent the difference value of waveform, and the third bit w3 represents the sign (+/−). As shown in Table 4, "0", "1", "2" and "4" are specified by corresponding combinations of the first and second bits w1 and w2.

TABLE 4

| w1 | w2 | Data |
|---|---|---|
| 0 | 0 | 0 |
| 0 | 1 | 1 |
| 1 | 0 | 2 |
| 1 | 1 | 4 |

Of the waveform difference value data that are written in the above way, data corresponding to addresses specified by the step data of waveform supplied from the waveform step register 20-1 and the signal MAIN/-SUB supplied from the tone color control register 40-1 are successively read out.

[4] Channel control section 40

The channel control section 40 includes the tone color control register 40-1 as mentioned above. The tone color control register 40-1 consists of a shift register which shifts data under the control of the clock Ø (see (a) in FIG. 5). It effects shifting in four stages with a capacity of one bit.

The tone color control register 40-1 specifies the MAIN characteristic if its content is logic value "1" while it specifies the SUB characteristic if its content is logic value "0". When rewriting the content of the tone color control register 40-1, the relevant data is transmitted to the line of the weight "1" of the data bus D1, and the control signal M/SW is provided as a low level signal from the control bus C1.

The control signal M/SW mentioned above is supplied to the NAND gate NAND40-1 to enable a transfer gate G40-1 while disabling a transfer gate G40-2 on the recirculation loop for the tone color control register 40-1. Thus, the data transmitted to the data bus D1 can be written in the tone color control register 40-1. In this case, the control section 3 can specify the individual channels according to the timing signals shown in (g) to (j) in FIG. 5, so that each channel can be identified.

Further, the control section 3 can read out data for MAIN/SUB written in the tone color control register 40-1 by setting the control signal M/SR to the low level, and the output can be obtained on the line of the weight "1" of the data bus D1.

Now, the case when data shown in Table 5 is written in the tone color control register 40-1 will be described.

TABLE 5

| Channel | Data | MAIN/SUB |
|---|---|---|
| 1 | 0 | SUB |
| 2 | 1 | MAIN |
| 3 | 1 | MAIN |
| 4 | 1 | MAIN |

Figure 5:
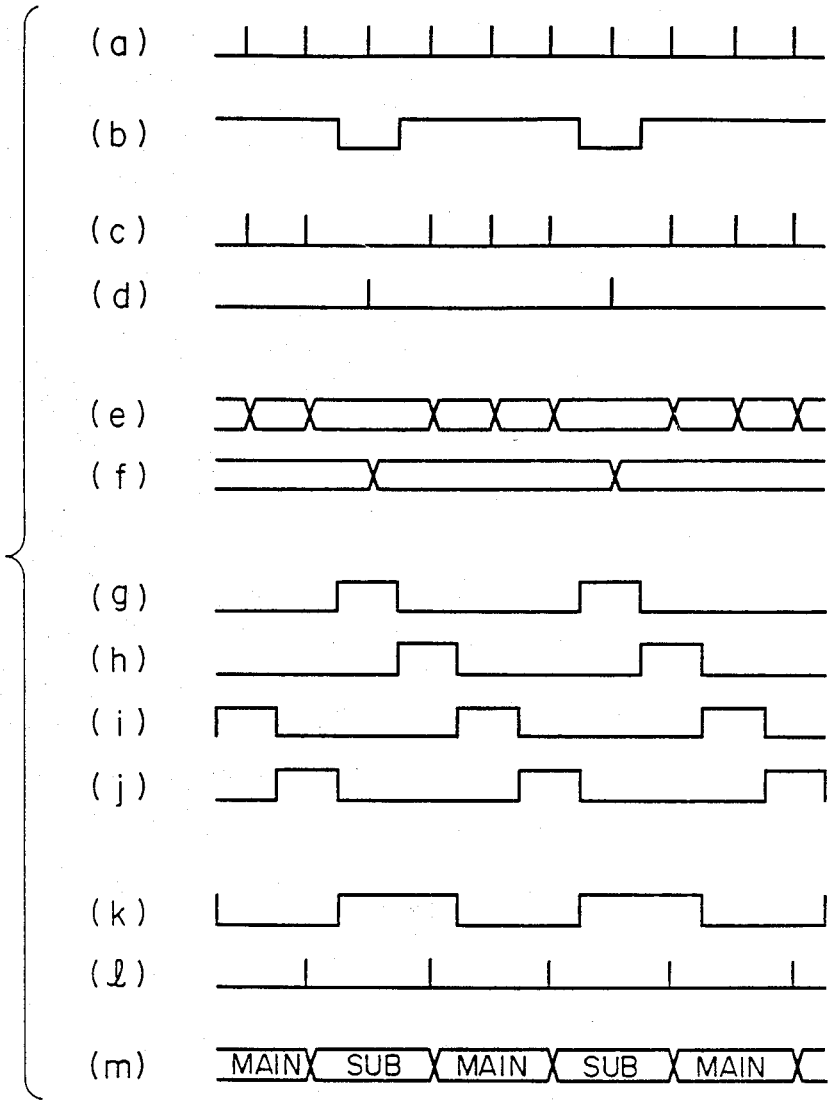
FIG. 5 is a time chart for explaining the operation of the embodiment.

In this case, the signal MAIN/SUB provided from the tone color control register 40-1 is as shown in (b) in FIG. 5. This signal is supplied to the address terminal MAIN/SUB of the waveform RAM 30-1 and is also supplied to an AND gate AND40-1 in the channel control section 40 both directly and also through an AND gate AND40-2 and an inverter I40-1. Further, it is supplied to the sections to be described later. It is further supplied as a control signal $\overline{\text{MAIN/SUB}}$ to the ADSR register section 50.

The AND gates AND40-1 and AND40-2 mentioned above are supplied with the reference clock Ø shown in (a) in FIG. 5, and the AND gate AND40-1 provides the clock ØM as shown in (c) in FIG. 5 while the AND gate AND40-2 provides a clock ØS as shown in (d) in FIG. 5. These clocks ØM and ØS are supplied to the accumulating section 100 and other sections to be described later.

[5] ADSR register section 50

The ADSR register section 50 includes latches 50-1 and 50-2 for storing attack clock selection data determining the attack period, latches 50-3 and 50-4 for storing delay clock selection data determining the decay period, latches 50-5 and 50-6 for storing release clock selection data determining the release period, and latches 50-7 and 50-8 for storing sustain level data determining the sustain level.

Of the two different kinds of tones MAIN and SUB, the MAIN tone data are stored in the latches 50-1, 50-3, 50-5 and 50-7 while the SUB tone data are stored in the latches 50-2, 50-4, 50-6 and 50-8.

These data determine the shape of the envelope waveform as shown in FIG. 4. More particularly, the attack clock selection data stored in the latches 50-1 and 50-2 determine the attack period (from the start of sound generation till the instant of reaching of the maximum level), the decay clock selection data stored in the latches 50-3 and 50-4 determine the decay period (from the reaching of the maximum level until the reaching of a sustain level), and the release clock selection data stored in the latches 50-5 and 50-6 determine the release period (from the reaching of the sustain level until the end of the sound production). Further, the sustain level data stored in the latches 50-7 and 50-8 determine the sustain level.

If the sustain level data is set to be the same as the maximum level (the sustain level data being provided with the same weights as the upper four bits of the envelope data provided from the envelope counter section 70, an envelope for an organ sound can be provided. If the sustain level data is set to be the same as the minimum level (i.e., zero level), an envelope for a string musical instrument sound can be provided. If the sustain level is set to the level as shown in FIG. 4, an envelope having the attack, decay, sustain and release states can be obtained.

Now, the case of setting data in the latches 50-1 to 50-8 will be described. When coupling the attack clock selection data to the latches 50-1 and 50-2, the SUB data is provided from the control section 3 to the data bus D1 and is set in the latch 50-1 under the control of a clock ØTA. The clock ØTA is provided from the control section 3 and is common to the latches 50-1 and 50-2.

Then, the MAIN data is provided from the control section 3 to the data bus D1 and is set in the latch 50-1 while the SUB data having been supplied to the latch 50-1 is set in the latch 50-2 under the control of the clock ØTA.

In this way, the attack clock selection data for the MAIN data is set in the latch 50-1 while the attack clock selection data for the SUB data is set in the latch 50-2.

The decay clock selection data are also set in the latches 50-3 and 50-4 in the manner as described above. In this case, the control section 3 supplies a read clock ØTD to the latches 50-3 and 50-4.

Further, the release clock selection data can be set in the latches 50-5 and 50-6 and the sustain level data in the latches 50-7 and 50-8 in the manner as described above. In this case, the control section 3 supplies a clock ØTR to the latches 50-5 and 50-6 and a clock ØTS to the latches 50-7 and 50-8 as the read clock.

The data which is stored in the latches 50-1 to 50-8 in the above manner is selectively provided according to the signal MAIN/SUB supplied from the channel control section 40 and signals ATT, DEC and REC supplied from the status register section 80 to be described later.

The output of the latch 50-1 is supplied through transfer gates G50-1 to G50-4 and also through transfer gates G50-5 to G50-8 to the envelope clock generating section 60. The output of the latch 50-2 is supplied through transfer gates G50-9 to G50-12 and also through the transfer gates G50-5 to G50-8 to the envelope clock generating section 60.

As the gate signal to the transfer gates G50-1 to G50-4 a signal from an inverter I50-1 inverting the aforementioned signal MAIN/SUB is supplied. Thus, when the channel control section 40 specifies a MAIN characteristic tone, the transfer gates G50-1 to G50-4 is enabled.

Conversely, the signal $\overline{\text{MAIN/SUB}}$ mentioned above is supplied as the gate signal to the transfer gates G50-9 to G50-12. Thus, when the channel control section 3 specifies a SUB characteristic tone, the transfer gates G50-9 to G50-12 are enabled.

The transfer gates G50-5 to G50-8 are enabled when the signal ATT is supplied from the status register section 80 to them.

The attack clock selection data for the MAIN and SUB tones stored in the latches 50-1 and 50-2 are selectively supplied to the envelope clock generating section 60 only when the envelope status is attack and also when specified by the signal MAIN/SUB.

Now, the case when the decay clock selection data stored in the latches 50-3 and 50-4 are supplied to the envelope clock generating section 60 will be described.

The output of the latch 50-3 is supplied through transfer gates G50-13 to G50-16 and also through transfer gates G50-17 to G50-20 to the envelope clock generating section 60. The output of the latch 50-4 is supplied through transfer gates G50-21 to G50-24 and also through the transfer gates G50-17 to G50-20 to the envelope clock generating section 60.

The gate signal to the transfer gates G50-13 to G50-16 is a signal obtained from an inverter I50-2 inverting the aforementioned signal $\overline{\text{MAIN/SUB}}$. Thus the transfer gates G50-13 to G50-16 are enabled when the channel control section 40 specifies a MAIN characteristic tone.

The gate signal to the transfer gates G50-21 to G50-24 is the aforementioned signal $\overline{\text{MAIN/SUB}}$. Thus, the transfer gates G50-21 to G50-24 are enabled when the channel control section 40 specifies a SUB characteristic tone.

The transfer gates G50-17 to G50-20 are enabled when the signal DEC is supplied from the status register section 80.

In the above way, the decay clock selection data for the MAIN and SUB tones stored in the latches 50-3 and 50-4 are supplied only when the envelope status is decay and when specified by the signal MAIN/SUB.

Now, the case when the release clock selection data stored in the latches 50-5 and 50-6 is supplied to the envelope clock generating section 60 will be described.

The output of the latch 50-5 is supplied through transfer gates G50-25 to G50-28 and also through transfer gates G50-29 to G50-32 to the envelope clock generating section 60. The output of the latch 50-6 is supplied through transfer gates G50-33 to G50-36 and also through transfer gates G50-29 to G50-32 to the envelope clock generating section 60.

The gate signal to the transfer gates G50-25 to G50-28 is a signal obtained from an inverter 150-3 inverting the aforementioned signal $\overline{\text{MAIN/SUB}}$. Thus, the transfer gates G50-25 to G50-28 are enabled when the channel control section 40 specifies a MAIN characteristic tone.

The gate signal to the transfer gates G50-33 to G50-36 is the aforementioned signal $\overline{\text{MAIN/SUB}}$. Thus, the transfer gates G50-33 to G50-36 are enabled when the channel control section 60 specifies a SUB characteristic tone.

The transfer gates G50-29 to G50-32 are enabled when the signal REL is supplied from the status register section 80.

In the above way, the release clock selection data for the MAIN and SUB tones stored in the latches 50-5 to 50-6 is selectively supplied to the envelope clock generating section 60 only when the envelope status is released and when specified by the signal MAIN/SUB.

Now, the case when the sustain level data stored in the latches 50-7 and 50-8 is supplied to the status register section 80 will be described.

The output of the latch 50-7 is supplied through transfer gates G50-37 to G50-40 to the status register section 80. The output of the latch 50-8 is supplied through transfer gates G50-41 to G50-44 to the status register section 80.

The gate signal to the transfer gates G50-37 to G50-40 is a signal obtained from an inverter I50-4 inverting the aforementioned signal $\overline{\text{MAIN/SUB}}$. Thus, the transfer gates G50-37 to G50-40 are enabled when the channel control section 40 specifies a MAIN characteristic tone.

Meanwhile, the gate signal to the transfer gates G50-41 to G50-44 is the aforementioned signal $\overline{\text{MAIN/SUB}}$. Thus, the transfer gates G50-41 to G50-44 are enabled when the channel control section 40 specifies a SUB characteristic tone.

In this way, the sustain level data for the MAIN and SUB tones stored in the latches 50-7 and 50-8 is selectively supplied to the status register section 80 when specified by the signal MAIN/SUB.

[6] Envelope clock generating section 60, envelope counter section 70 and status register section 80

In the instant embodiment, the tones are envelope controlled by the envelope clock generating section 60, envelope counter section 70 and status register section 80.

The envelope clock generating section 60 supplies an envelope clock ENV CLK at a rate corresponding to the data supplied from the ADSR register section 50 and signals ATT, DEC, REL and SUS supplied from the status register section 80 to the envelope counter section 70. (When the signal SUS is supplied, the envelope clock ENV CLK is not generated.)

A circuit similar to the envelope clock generating circuit 60 is disclosed in U.S. Patent Application Ser. No. 207,749 filed on Mar. 15, 1979 by the applicant and entitled "Tone Waveform Setting System for Electronic Musical Instrument".

The envelope clock ENV CLK generated from the envelope clock generating section 60 is supplied to the envelope counter section 70.

The detailed circuit construction of the envelope counter section 70 is not given here, but the techniques involved in this circuit are disclosed in the aforementioned Japanese Patent Application No. 31369/1978 (Japanese Patent Disclosure No. 123937/1979 entitled "Tone Waveform Setting System for Electronic Musical Instrument"). Briefly, it includes an adder, a shift register which effects 5-bit parallel shifting in four stages and other gate circuits. The shift register mentioned effects shifting under the control of the clock Ø (see (a) in FIG. 5).

The signals ATT, DEC, REL and SUS are supplied to the envelope counter section 70 from the status register section 80, and they specify either up-counting (at the time of the attack) or down-counting (at the time of the decay and release).

The 5-bit output of the envelope counter 70 is supplied to the multiplying section 90. Also, for detecting the coincidence with the sustain level, the upper four bits (with the weights of "2", "4", "8" and "16") are supplied to exclusive NOR gates ENOR80-1 to ENOR80-4. The envelope counter section 70 supplies an envelope carry (borrow) signal ENVCO to a carry input terminal Ci of a half adder 80-1 in the status register section 80.

The details of the status register section 80 will now be described. The status register section 80 includes a status register 80-2 and a sustain register 80-3. The status register 80-2 is a 4-stage 2-bit parallel shift register which effects shifting under the control of the clock (see (a) in FIG. 5). The sustain status register 80-3 is a shift register having a 1-bit 4-stage construction effecting shifting under the control of the clock Ø (see (a) in FIG. 5). The relation of the contents of the status register 80-2 and sustain register 80-3 to the envelope status is as shown in Table 6.

TABLE 6

| Status register 80-2 | | Sustain status register 80-3 | |
|---|---|---|---|
| 2 | 1 | 1 | Envelope status |
| 0 | 0 | 0 | Clear (vacant channel) |
| 0 | 1 | 0 | Attack |
| 1 | 0 | 0 | Decay |
| | | 1 | Sustain |
| 1 | 1 | 0 | Release |

As is shown in Table 6 and also in FIG. 4, the decay and sustain states are determined by whether the content of the sustain status register 80-3 is "0" or "1".

To change the content of the status register 80-2 from the clear state to the attack state, i.e., to start production of sound, a control signal KEYON from the control section 3 is set to a low level (logic value "0"). In the normal state, the control signal KEYON is at a high level (logic value "1").

The control signal KEYON is inverted by the inverter I80-1 and then supplied to an OR gate OR80-1, and a signal of a logic value "1" is supplied to an input terminal of weight "1" of the status register 80-2. Meanwhile, the control signal KEYON is supplied to the AND gate AND80-1, and a signal of logic value "0" is supplied to an input terminal with a weight "2" of the status register 80-2.

As a result, the content of the status register 80-2 becomes "0, 1", i.e., it is set to the attack state. This content is shifted progressively under the control of the clock Ø, and is supplied from the output terminal to a decoder 80-4. When the attack state is detected by the decoder 80-4, the signal ATT is supplied to the transfer gates G50-5 to G50-8, envelope clock generating section 60 and envelope counter section 70 to start operation in the attack state.

The output of the status register 80-2 is supplied for recirculation through the half adder 80-1 and also through the OR gate OR80-1 or through an OR gate OR80-2 and the AND gate AND80-1 to the input terminal.

While the operation of the channel for which the attack state is set in the manner as described above will be described in the following, it is to be understood that entirely independent envelope control operations are performed for the other channels as well.

For the channel for which the attack state is set, the envelope counter section 70 effects the operation of up-counting the envelope clock ENV CLK supplied from the envelope clock generating section 60.

Thus, the output progressively increases from "00000" to reach the maximum level "11111" as shown in FIG. 4. When the next pulse of the envelope clock ENV CLK is supplied, the envelope counter section 70 supplies the envelope carry signal ENVCO to the half adder 80-1.

As a result, the half adder 80-1 is caused to increment "+1" to the value "01" so far, and the status register 80-2 circulatingly holds the resultant content "10".

When the decoder 80-4 detects the decay state, it supplies the signal DEC to the transfer gates G50-17 to G50-20, envelope clock generating section 60, envelope counter section 70 and the AND gate AND80-2 in the status register section 80 to start operation in the decay state.

As a result, for the channel for which the decay state is set, the envelope counter section 70 effects down-counting operation according to the envelope clock ENV CLK supplied from the envelope counter section 70.

The output of the envelope counter section 70 is supplied to the accumulating section 90, and the upper 4-bit output is supplied to the exclusive NOR gates ENOR80-1 to ENOR80-4. The sustain level data from the ADSR register section 50 is supplied to the other input terminal of each of the exclusive NOR gates ENOR80-1 to ENOR80-4. When coincidence of the contents of all the bits occurs, a logic value "1" is provided from an AND gate AND80-3, to which the outputs of the exclusive NOR gates ENOR80-1 to ENOR80-4 are applied.

The output of the AND gate AND80-3 is supplied to the AND gate AND80-2, and if the other inputs to the AND gate AND80-2 are all "1" (with the signal DEC from the decoder 80-4 supplied as logic value "1" and the output of the inverter I80-2 inverting the output of the sustain status register 80-3 supplied as logic value "1"), the signal is supplied through the OR gate OR80-3 to the sustain status register 80-3.

Thus, the content of the sustain status register 80-3 for the relevant channel becomes logic value "1", and the output is supplied as signal SUS to the envelope clock generating section 60 and envelope counter section 70 to hold the sustain level of the envelope data. The output of the sustain status register 80-3 is supplied to the AND gate AND80-4. Since the signal REL of the decoder 80-4 is supplied through the inverter I80-3 to the AND gate AND80-4, the AND gate AND80-4 provides a logic value "1" through the OR gate OR80-3 to the input terminal of the sustain status register 80-3.

Also, a signal "1" representing the sustain state is circulatedly stored in the relevant channel of the sustain status register 80-3.

For switching the sustain state over to the release state, the control signal KEYOFF from the control section 3 is set to a low level (logic value "0"). In the normal state of the control signal KEYOFF, it is at a high level (logic value "1").

The control signal KEYOFF is inverted through an inverter I80-4, the output of which is supplied to the OR gates OR80-1 and OR80-2. Thus, the content of the status register 80-2 becomes "1, 1" representing the release state, and the signal REL is provided from the decoder 8-4.

The signal REL is supplied to the transfer gates G50-29 to G50-32 and is also supplied to the envelope clock generating section 60 and envelope counter section 70. The signal REL is supplied through the inverter I80-3 to the AND gate AND80-4.

As a result, the release clock selection data is supplied to the envelope clock generating section 60 while the envelope clock ENV CLK at a rate corresponding to that data is supplied to the envelope counter section 70, thus causing the envelope counter section 70 to start down-counting.

Also, since the AND gate AND80-4 is closed, the recirculation loop is closed to hold logic value "0" as the content of the sustain status register 80-3.

The down-counting is continued until a carry (borrow) signal ENVCO from the envelope counter section 70 is provided, and the data is supplied to the multiplying section 90. When the carry signal ENVCO is provided, it is supplied to the carry input terminal of the half adder 80-1 to set the content of the relevant channel of the status register 80-2 to "0, 0". As a result, the tone output for that channel is stopped.

It will be understood that envelope data as shown in FIG. 4 is provided according to the individual attack, decay, sustain and release states. Particularly, when the control section 3 provides the control signal KEYOFF immediately upon detection of a key-off state of the keyboard, even if the status register 80-2 contains stored data "0, 1" and "1, 0" representing the attack and decay states, the release state "1, 1" can be forcibly brought about to cause the release operation.

The signals KEYON and KEYOFF, in addition to represent the KEYON and KEYOFF in case of the manual performance, represent the start of sound production and transition to the release state at the time of the automatic performance.

The envelope clock generating section 60 and envelope counter section 70 are operated under the control of the status register section 80, and the envelope data for the four channels are successively provided to the multiplying section 90 on a time division basis.

The control section 3 can effect such processes as detecting a vacant channel by reading the contents of the status register 80-2 and sustain status register 80-3. When the control section 3 provides the control signal ENVR as a low level signal, the output is supplied through the inverter I80-5 to the transfer gates G80-45 to G80-47 to enable the transfer gates G80-45 to G80-47. Thus, data of the weights "1" and "2" of the status register 80-2 are supplied to the lines of the weights "1" and "2" of the data bus D1, and the content of the sustain status register 80-3 is supplied to the line with the weight "4" of the data bus D1.

[7] Multiplying section 90

The multiplying section 90 includes a decoder 90-1 and a shift circuit 90-2. To the decoder 90-1 is supplied the waveform difference value data w1 and w2 provided from the waveform RAM section 30.

The four different outputs as shown in Table 4 are selectively obtained according to the data w1 and w2. More particularly, when the difference value data w1 and w2 is "0, 0", the multiplying section 90 provides a logic value "0" irrespective of the value of the envelope data from the envelope counter 70.

More particularly, the "0" output from the decoder 90-1 is supplied to the transfer gates G90-1 to G90-7 in the shift circuit 90-2. The transfer gates G90-1 to G90-7 are held at one end at a ground level (i.e., at a low level corresponding to the logic value "0") and are connected at the other end to output lines L1 to L7. When the output of "0" is provided from the decoder 90-1, the outputs of all the lines L1 and L7 become "0".

The output of "1" of the decoder 90-1 is supplied to transfer gates G90-8 to G90-14 in the shift register 90-2. The transfer gates G90-8 to G90-12 receive at one end the envelope data of the envelope counter circuit 70, and the transfer gates G90-13 and G90-14 are held at one end at the ground level and connected at the other end to the output lines L1 and L7. Thus, when the decoder 90-1 provides an output of "1", envelope data is directly provided from the lines L1 to L7.

The output of "2" from the decoder 90-1 is supplied to the transfer gates G90-15 to G90-21 of the shift circuit 90-2. The transfer gate G90-15 is held at one end at the ground level and connected at the other end to the line L1. The transfer gates G90-16 to G90-20 are connected at one end to respective envelope output terminals of the envelope counter section 70 and connected at the other end to the lines L2 to L6. The transfer gate G90-21 is held at one end at the ground level and is connected at the other end to the line L7. Thus, when the decoder 90-1 provides the output "2", data of a value obtained as a result of doubling (i.e., shifting by one bit) the envelope data is obtained from the lines L1 to L7.

The output of "4" of the decoder 90-1 is supplied to transfer gates G90-22 to G90-28 in the shift circuit 90-2. The transfer gates G90-22 and G90-23 are held at one end to the ground level and are connected at the other end to the lines L1 and L2. The transfer gates G90-24 to G90-28 are connected at one end to respective envelope output terminals of the envelope counter section 70 and at the other end to the lines L3 to L7. Thus, when the decoder 90-1 provides the output of "4", data of a value obtained as a result of quadrupling (i.e., shifting by 2 bits) the envelope data is obtained from the lines L1 to L7.

In the above way, the waveform difference value data w1 and w2 is multiplied with the envelope data, and the resultant data is transmitted to the accumulating section 100.

The transfer gates G90-29 and G90-30 in the multiplying section 90 are enabled when the scale clock SC CLK is generated from the scale clock generating section 10, whereby the difference value data w1 and w2 is supplied to the decoder 90-1. At the time of the generation of the scale clock SC CLK, the multiplying section 90 provides effective data, and at the other timings the multiplying section 90 provides "0".

[8] Accumulating section 100

In the accumulating section 100, the envelope controlled difference value data for the two different kinds of data MAIN and SUB are accumulated and when a plurality of tones are being generated, the sums of the amplitude values are alternately supplied to an external D/A converter for the individual MAIN and SUB characteristic tones.

Now, the case when the channel 1 is assigned to the SUB characteristic tones and the channels 2 to 4 are assigned to the MAIN characteristic tones, as shown in Table 5, will be described.

The 7-bit data supplied from the multiplying section 90 through the lines L1 to L7 is supplied through exclusive OR gates EOR100-1 to EOR100-7 to A input terminals with weights "1", "2", "4", "8", "16", "32" and "64" of an adder 100-1. The output w3 (sign bit) of the waveform RAM 30-1 is supplied through a transfer gate G100-1 to the other input terminal of each of the exclusive OR gates EOR100-1 to EOR100-7, A input terminals with weights "128", "256" and "512" and a carry input terminal Cin of the adder 100-1.

If the output data w3 from the waveform RAM 30-1 is "0" when the scale clock SC CLK is generated from the scale clock generating circuit 10-3, the adder 100-1 adds the data supplied to B input terminals (10 bits with weights of "1" to "512") and the data supplied from the multiplying section 90 to provide 10 bits with weights "1" to "512" from S output terminals. If the data w3 is "1", data obtained as a result of inversion of the sign of the output data of the multiplying section 90 to a negative value is supplied to the A input terminals and carry input terminal Cin of the adder 100-1 for addition to the data to the B input terminals, the result being provided from the S output terminals.

In the above way, either positive or negative difference value data can be selectively accumulated.

The data provided from the adder 100-1 is supplied to transfer gates G100-2 to G100-11, and the outputs of the transfer gates G100-2 to G100-11 are supplied to latches 100-2 and 100-3. The output from a carry output terminal Cout of the adder 100-1 and the waveform data w3 supplied from the waveform RAM 30-1 through the transfer gate G100-12 is coupled to an exclusive OR gate EOR100-1, and the output therefrom is supplied to the transfer gates G100-2 to G100-11.

The exclusive NOR gate ENOR100-1 effects processing at the time of occurrence of overflow in the adder 100-1. In the normal state, the transfer gates G100-2 to G100-11 are "on", and they are disabled when a positive or negative overflow occurs.

At the occurrence of an overflow, the transfer gates G100-13 to G100-22 are enabled so that the output of the latch 100-2 or 100-3 is coupled to the latch 100-3. The output of an inverter I100-1 inverting the output of the exclusive NOR gate ENOR100-1 is supplied to the transfer gates G100-13 to G100-22.

The latches 100-2 and 100-3 effect reading operation under the control of the respective clocks ØM and ØS (see (c) and (d) in FIG. 5), and their state of data storage is changed as shown in (e) and (f) in FIG. 5. Thus, in this case the data for the channel 1 is stored in the latch 100-3 while the data for the channels 2 to 4 is stored in latch 100-2.

The data of the latch 100-2 is supplied through transfer gates G100-23 to G100-32, which are on-off controlled according to the signal MAIN/SUB (see (b) in FIG. 5) from the channel control section 40, to the B input terminals of the adder 100-1, while it is also supplied through transfer gates G100-33 to G100-42, to which a clock tn for inverting the level for every two channels (see (k) in FIG. 5) is supplied, to the latch 100-4 and read therein under the control of a clock Øn (see (l) in FIG. 5).

Meanwhile, the data of the latch 100-3 is supplied through transfer gates G100-43 to G100-52, to which the output of the inverter I100-2 (see (b) in FIG. 5) inverting the signal MAIN/SUB from the channel control section 40 is supplied, to the B input terminals of the adder 100-1, and is also supplied through transfer gates G100-53 to G100-62, to which the clock tn (see (k) in FIG. 5) is supplied through the inverter I100-43, to the latch 100-4 and read therein.

Thus, the MAIN and SUB tones are provided from the latch 100-4 alternately in synchronism to the clock Øn (see (l) in FIG. 5) through a bus line B3 (which is a 10-bit line) to the D/A converter, as shown in (m) in FIG. 5.

As described earlier, at the time of an overflow in the adder 100-1, the outputs of the transfer gates G100-23 to G100-32 and the outputs of the transfer gates G100-43 to G100-52 are supplied to the transfer gates G100-13 to G100-22 for storing the data before the overflow in the latch 100-2 or 100-3.

As has been shown, in the accumulating section 100 the amplitude data of the two different kinds of tones MAIN and SUB or the sum data of the amplitude data for each channel are stored in the independent latches 100-2 and 100-3, and these data are alternately supplied to the D/A converter. Outside the LSI chip 1, the alternately provided data can be independently filtered, or the volume ratio can be varied between the MAIN and SUB tones.

To this end, the two different systems of tones, for instance melody and accompaniment tones or manual and automatic performance tones, can be independently processed outside the chip.

It is to be appreciated that with the above embodiment the manual performance using the keyboard 4 (i.e., performance of MAIN characteristic tones) or automatic performance with the performance memory 5 (i.e., performance of SUB characteristic tones) can be obtained on a time division basis for four channels, the individual channels are specified for generating one of the two different kinds of tones MAIN and SUB, and also waveforms or envelopes can be set for the individual tones to permit simultaneous generation of the tones. Thus, two different kinds of tones can be obtained with very little hardware. Further, since the circuit of the above embodiment is constituted by a single-chip LSI, it is possible to provide a very compact electronic musical instrument.

Figure 6:
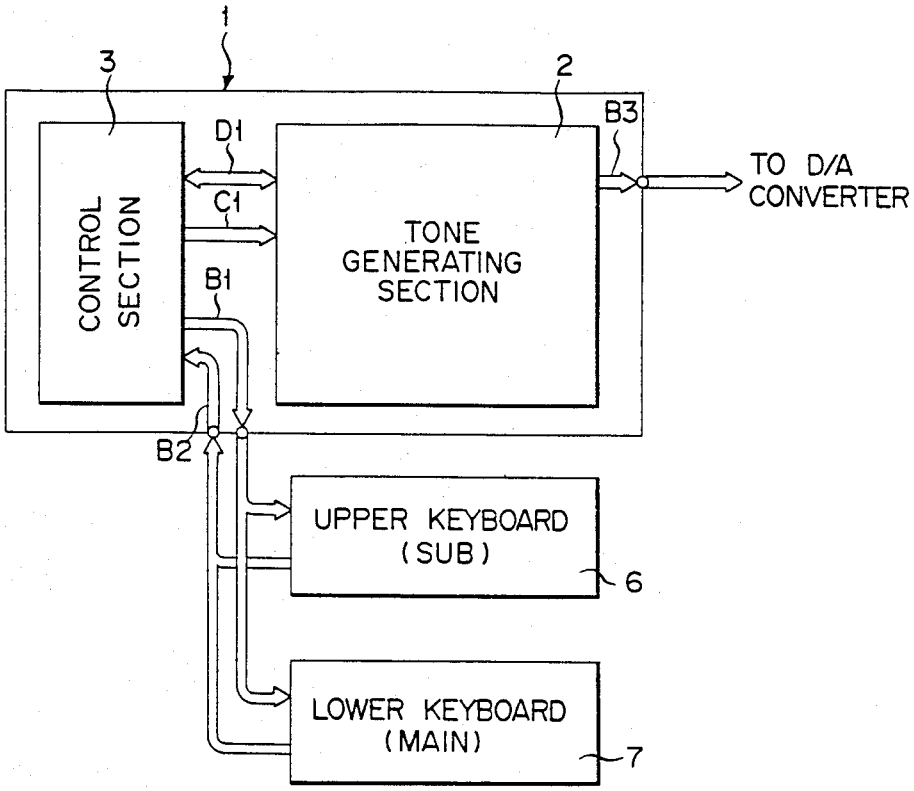
FIGS. 6 and 7 are block diagrams showing different embodiments of the invention.

FIG. 6 shows a second embodiment of the invention. In this embodiment, upper and lower keyboards 6 and 7 are connected via bus line B1 and B2 to control section 3. The lower keyboard 7 is used for manual main performance (MAIN), and the upper keyboard 6 is used for accompaniment (SUB). Tones up to a total of four channels can be simultaneously produced with the upper and lower keyboards 6 and 7. In this case, the specification as to the assignment of each channel to either upper keyboard 7 (MAIN) or lower keyboard 7 (SUB) can be obtained by operating an external switch as in the preceding first embodiment, and also the other construction is entirely the same as in the first embodiment.

Thus, with the second embodiment, like the preceding embodiment, it is possible to obtain two different kinds of tones with very little hardware and also provide a very compact electronic musical instrument using a single-chip LSI.

Figure 7:
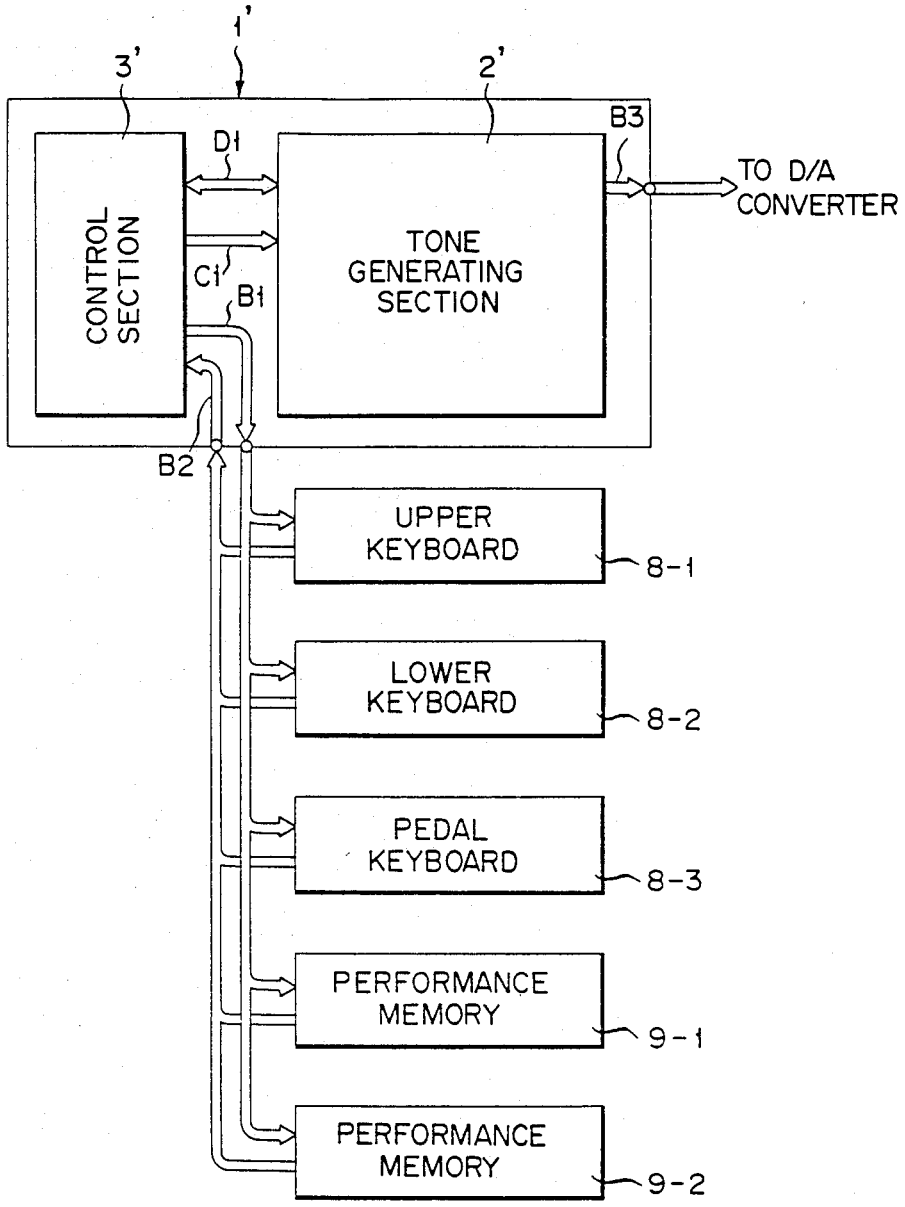

FIG. 7 shows a third embodiment of the invention. In this embodiment, performance is obtained on a time division basis for eight or more channels, for instance 8 to 12 channels. Thus, LSI chip 1' has a construction capable of operation on a time division basis for 8 to 12 channels. Registers and other parts in tone generating section 2' each having a capacity for 8 to 12 channels, and control section 3' is capable of operation on a time division basis for 8 to 12 channels.

In this embodiment, upper and lower keyboards 8-1 and 8-2, a pedal keyboard 8-3 and performance memories 9-1 and 9-2 are connected to the control section 3' via bus lines B1 and B2. Like the first embodiment, the upper and lower keyboards 8-1 and 8-2, a pedal keyboard 8-3 and performance memories 9-1 and 9-2 are used for producing respective MAIN and SUB characteristic tones. The individual keyboards 8-1 to 8-3 or performance memories 9-1 to 9-2 may be freely assigned to either MAIN or SUB system.

To this end, the operation panel of the instrument is provided with an external switch for specifying either upper keyboard 8-1, lower keyboard 8-2, pedal keyboard 8-3 or performance memory 9-1 or 9-2 to a given channel and also with a switch for assigning each channel to either MAIN or SUB system.

With the third embodiment of the electronic musical instrument, since the number of channels is increased, in addition to be able to obtain the same effects as in the preceding first and second embodiments, more complicated performance can be obtained with the time division basis operation of a single tone generating section 2', that is, musically richer and highly advanced polyphonic performance can be obtained.

While the above embodiments of the invention are concerned with an electronic musical instrument, in which a time division basis processing is effected for four channels, and an electronic musical instrument, in which a time division basis processing is effected for 8 to 12 channels, the invention is further applicable to electronic musical instruments, in which a time division processing is effected for a greater number or a smaller number of channels.

Further, while in the above embodiments two different kinds of tones MAIN and SUB were adapted to be selectively specified for each channel, and the present invention is also applicable to a case where each channel is fixedly set for either MAIN or SUB system. In this case, it is possible to select either of two cases, in one of which all the channels are specified to a single tone, and in the other of which thereof some of the channels are specified to the MAIN tones and the remaining channels are specified to the SUB tones.

Further, while the above embodiments are concerned with the case where two different kinds of tones MAIN and SUB are generated, it is also possible to arrange that three or more different kinds of tones be selectively generated from respective time division basis process channels.

Also, while in the above embodiments it has been adapted to control the two different kinds of tones from the outside of the LSI by independently providing a latch for storing the MAIN data and a latch for storing the SUB data in the accumulating section 100, and providing the amplitude data for the two different kinds of tones and the sum data of the amplitude data for each channel on a time division basis to the D/A converter, in case where such external control is not made, it is possible to permit envelope controlled difference value data for all the channels to be progressively accumulated in a single latch. Further, by permitting the latch output to be supplied to the external D/A converter, it is possible to obtain amplitude level data or sum level data of the amplitude level of each channel that changes with time. Moreover, while in the above embodiments the scale clock SC CLK has been produced according to the pitch of the tone, and the address of the waveform has been advanced according to this clock, the invention is of course applicable to an electronic musical instrument, in which phase angle data is selected according to the pitch and this phase angle data is accumulated on a time division basis for individual channels for specifying the phase angle of the waveform, for instance an electronic musical instrument as disclosed in U.S. Pat. No. 3,882,751 (entitled "Electronic Musical Instrument" and filed by NIPPON GAKKI SEIZO K.K.). In this case, the waveform memory may be switched for each of the different kinds of tones.

Further, while in the above embodiments difference value data of waveform has been stored in the waveform RAM 30-1, it is also possible to store amplitude value data of waveform. In such a case, the accumulating section 100 can be omitted.

Additionally, while in the above embodiments the electronic musical instrument has been constructed with a digital circuit, the invention is also applicable where a waveform memory or an envelope memory is constituted by an analog circuit (which is controlled by voltage level), as disclosed in the Japanese Patent Publication No. 46088/1977.

Further, while in the above embodiments the waveform and envelope waveform are selected and switched as the characteristics of tones for simultaneously producing two different kinds of tones, it is possible to change the method of provision of vibrato effect or tremolo effect for the different kinds of tones or change other effects for the different kinds of tones.

Various other changes and modifications can, of course, be made without departing from the scope of the invention.

As described in the foregoing, according to the invention, there is provided an electronic musical instrument, in which a plurality of specifying means for specifying tones of different characteristics and the pitches of these tones are provided, and the tones specified by these specifying means are produced by operating a single tone generating means on a time division basis for a plurality of channels, said plurality of channels of said tone generating means being commonly used by the plurality of specifying means for producing tones. Thus, it is possible to simultaneously produce a plurality of tones of different characteristics from the single tone generating means and thus provide an electronic musical instrument which uses reduced hardware and is compact in construction.

What is claimed is:

1. An electronic musical instrument capable of simultaneously generating a plurality of tones for each of a plurality of channels in a time division basis processing, comprising:

channel control means including a shift register having shift stages corresponding in number to the plurality of channels provided by said time division basis processing, for storing different characteristic control data for each channel, and means coupled to said shift register for effecting control of channels to assign one of at least two different kinds of tones for each channel according to said characteristic control data delivered from said shift register; and tone generating means coupled to said channel control means and including tone waveform memory means for storing data of at least two different waveforms representing different tone timbres and arranged to be supplied with said characteristic control data stored in said shift register to determine the waveform to be read out for each channel, wherein said tone generating means generates a tone timbre determined by the read-out waveform in the time division basis processing according to the control by said channel control means.

2. The electronic musical instrument according to claim 1, wherein said tone generating means further includes scale clock generating means for generating a scale clock for determining the frequency of a tone, and the tone waveform memory means is operative to generate a tone waveform signal at a pitch based on the scale clock, and said tone generating means also includes envelope clock generating means for generating an envelope clock for determining an envelope of a tone, envelope waveform generating means for generating an envelope waveform signal at a rate based on the output of said envelope clock generating means, and synthesizing means for synthesizing the tone waveform signal and the envelope waveform signal to obtain an envelope-controlled tone waveform signal, and wherein said tone generating means is operated on a time division basis for the plurality of channels.

3. The electronic musical instrument according to claim 2, wherein said tone waveform memory means includes means for providing difference value data of waveforms, said synthesizing means includes means for effecting envelope control of said difference value data, and said electronic musical instrument further comprises accumulating means for accumulating envelope controlled difference value data for each channel, said accumulating means providing accumulated envelope-controlled difference value data on a time division basis for each of said different kinds of characteristics.

4. The electronic musical instrument according to claim 2, wherein said envelope clock generating means provides a specified one of at least two different kinds of envelope clocks for each channel on the basis of the control by said channel control means, and said envelope waveform generating means provides an said envelope waveform signal at a rate based on the specified envelope clock.

5. An electronic musical instrument comprising:

a plurality of specifying means including manual performance means for specifying production of tones by manual operation, and automatic performance means for automatically designating successive tones, each of said plurality of specifying means being capable of specifying a characteristic of a tone to be produced and a pitch thereof;

tone generating means for simultaneously generating a plurality of tones for each channel in a time division basis processing, and said tone generating means includes tone waveform memory means for storing data of at least two different waveforms, each of said waveforms representing a different tone timbre; and control means coupled to said plurality of specifying means for controlling the generation of tones by assigning said specifying means to individual channels of said tone generating means, said plurality of channels of said tone generating means being used by all of said plurality of specifying means for producing tones, and said control means includes memory means having memory areas corresponding in number to the number of channels provided by said time division basis processing, for storing characteristic control data for each channel, said characteristic control data determining the waveform to be read out from said tone waveform memory means for each channel.

6. The electronic musical instrument according to claim 5, wherein said memory means comprises a shift register having shift stages corresponding in number to the number of channels provided by the time division basis processing.

7. An electronic musical instrument comprising:

a single tone generating circuit means for generating a plurality of tones on a time division basis for a plurality of channels and including tone waveform memory means for storing data of at least two different waveforms, each of said different waveforms representing a different tone timbre;

means for specifying a different one of at least two different kinds of tones for each channel;

tone generating control means including a shift register having shift stages corresponding in number to the number of channels provided in the time division basis processing, for storing different characteristic control data for each channel specified by said specifying means;

channel control means for effecting control of channels to assign a different one of at least two different kinds of tones for each channel on the basis of said characteristic control data delivered from said shift register; and said single tone generating circuit means being operative to generate the plurality of tones each having a timbre determined by said different waveforms read out from the tone waveform memory means according to the characteristic control data supplied from said shift register for each of the plurality of channels.

8. The electronic musical instrument according to claim 7, wherein said specifying means includes means for specifying a plurality of combinations of a tone color and a pitch of a tone, and means for assigning the tones of the specified combinations to the respective channels.

9. The electronic musical instrument according to claim 8, wherein said specifying means includes manual performance means for specifying the production of tones by a manual operation, and automatic performance means for automatically specifying successive tones.

10. The electronic musical instrument according to claim 7, wherein said single tone generating circuit means further includes scale clock generating means for generating a scale clock for determining the frequency of a tone, and the waveform memory means generates a tone waveform signal at a pitch based on the scale clock and specified by said specifying means, and said single tone generating circuit means further includes envelope clock generating means for generating an envelope clock for determining an envelope of a tone, envelope waveform generating means for generating an envelope waveform signal at a rate based on the output of said envelope clock generating means and synthesizing means for synthesizing the tone waveform signal and the envelope waveform signal to obtain an envelope-controlled tone waveform signal.

11. The electronic musical instrument according to claim 10, wherein said envelope clock generating means includes means for generating a specified one of at least two different envelope clocks for each channel on the basis of the control by said channel control means, and said envelope waveform generating means generates an envelope waveform signal at a rate based on said envelope clock.

12. The electronic musical instrument according to claim 10, wherein said tone waveform memory means includes means for providing difference value data of waveforms, said synthesizing means includes means for effecting envelope control of said difference value data, said electronic musical instrument further comprises accumulating means for accumulating envelope controlled difference value data for each of the different kinds of tones, and said accumulating means includes means for providing accumulated data on a time division basis for said individual different kinds of tones.

13. An electronic musical instrument comprising:

tone generating means for simultaneously generating a plurality of tones from a plurality of channels in time division basis processing, said tone generating means including tone waveform memory means for storing data of at least two waveforms, wherein each waveform represents a different tone timbre;

specifying means coupled to said tone generating means for selectively specifying one of at least two different tone timbres for each channel; and channel control means for effecting control of said channels of the tone generating means to assign a musical tone to be produced for each channel, and for controlling the characteristic of a musical tone to be produced from each channel, and said channel control means includes memory means having memory areas corresponding in number to the number of channels by said time division basis processing, for storing characteristic control data for each channel, wherein said characteristic control data determines the waveform to be read out from said tone waveform memory means for each channel.

14. The electronic musical instrument according to claim 13, wherein said tone generating means further includes scale clock generating means for generating a scale clock for determining the frequency of a tone, and said tone waveform memory means generates a tone waveform signal having a pitch based on the scale clock and specified by said specifying means, and said tone generating means further includes envelope clock generating means for generating an envelope clock, envelope waveform generating means for providing an envelope waveform signal at a rate based on the output of said envelope clock generating means, and synthesizing means for synthesizing the tone waveform signal and the envelope waveform signal to obtain an envelope-controlled tone waveform signal.

15. The electronic musical instrument according to claim 14, wherein said envelope clock generating means is operative to provide a specified one of at least two different envelope clocks for each channel, and said envelope waveform generating means is operative to provide an envelope waveform signal at a rate based on said specified envelope clock.

16. The electronic musical instrument according to claim 13, wherein said memory means includes a shift register comprising shift stages corresponding in number to the number of channels based on time division basis processing, the characteristic control data stored in said shift register for each channel is provided in synchronism to the time division basis operation of said tone generating means, and said tone generating means generates a tone of a selected one of at least two kinds of characteristics according to the characteristic control data for each channel.

17. The electronic musical instrument according to claim 14, wherein said tone waveform memory means is operative to provide waveform difference value data, and said synthesizing means is operative to effect envelope control of said difference value data, and further comprising accumulating means for accumulating an envelope-controlled difference value data on a time division basis for each channel.

* * * * *

UNITED STATES PATENT AND TRADEMARK OFFICE

CERTIFICATE OF CORRECTION

PATENT NO. : 4,502,359

DATED : March 5, 1985

INVENTOR(S) : Shigenori MORIKAWA

It is certified that error appears in the above-identified patent and that said Letters Patent is hereby corrected as shown below:

In the heading of the patent, change the inventor's last name from "SANO" to --MORIKAWA--;

Column 4, line 61, after "[1] Scale" delete "or tone stage";

line 62, after "The scale or" insert --tone stage-- and delete "mate";

line 63, after "a scale" insert --or note--;

Column 5, line 2, after "and the scale" insert --,--;

Column 11, line 63, change "No. 207,749" to --No. 20,749--;

Column 18, line 53, after "channel," delete "and";
line 58, after "of which" delete "thereof".

Signed and Sealed this

*Eighth* Day of *October 1985*

[SEAL]

*Attest:*

*Attesting Officer*

DONALD J. QUIGG

*Commissioner of Patents and Trademarks—Designate*